US005525085A

United States Patent [19]

Liu

[11] Patent Number: 5,525,085

[45] Date of Patent: Jun. 11, 1996

[54] SPARKING TOY VEHICLE AND LAUNCHER THEREFORE

[75] Inventor: Dexter C. Liu, Portsmouth, R.I.

[73] Assignee: Liu Concept Designs & Associates, Newport, R.I.

[21] Appl. No.: 532,436

[22] Filed: Sep. 22, 1995

Related U.S. Application Data

[62] Division of Ser. No. 248,321, May 23, 1994, Pat. No. 5,460,560.

[51] Int. Cl.[6] ..... A63H 33/36

[52] U.S. Cl. ..... 446/23; 446/22; 446/430

[58] Field of Search ..... 446/22, 23, 429, 446/430

[56] References Cited

U.S. PATENT DOCUMENTS

| | | | |
|---|---|---|---|
| D. 230,040 | 1/1974 | Toy | 446/429 |
| 4,188,748 | 2/1980 | Rich | 446/430 |
| 4,373,290 | 2/1983 | Goldfarb | 446/429 |
| 4,418,495 | 12/1983 | Kennedy | 446/429 |
| 4,472,906 | 9/1984 | Cook | 446/429 |
| 4,479,326 | 10/1984 | Kennedy | 446/23 |
| 4,534,745 | 8/1985 | Jones | 446/429 |
| 4,571,212 | 2/1986 | Kakizaki | 446/23 |
| 4,732,569 | 3/1988 | Hippely | 446/430 |

*Primary Examiner* Sam Rimell
*Assistant Examiner* Jeffrey D. Carlson
*Attorney, Agent, or Firm* Salter & Michaelson

[57] ABSTRACT

A toy includes a toy vehicle, a launching assembly, and a rotatable sparking mechanism for generating sparks before the vehicle is launched from the launching assembly. In a preferred embodiment, the launching assembly includes a base track having a rack gear, and a push handle including a spring biased plunger. The sparking mechanism is mounted in the vehicle and a drive gear for sparking mechanism extends downwardly where it meshes with the rack gear when the vehicle is received on the base track. The push handle is slidably movable for advancing the vehicle along the base track wherein advancement of the vehicle causes rotation of the sparking mechanism thereby generating sparks, and further wherein a resistance of the sparking mechanism maintains the plunger in a depressed disposition until the drive gear disengages the rack gear.

3 Claims, 7 Drawing Sheets

SPARKING TOY VEHICLE AND LAUNCHER THEREFORE

This is a division of application Ser. No. 08/248,321, filed May 23, 1994, now U.S. Pat. No. 5,460,560.

BACKGROUND AND SUMMARY OF THE INVENTION

The instant invention relates to toy vehicles and more particularly to a sparking toy vehicle and a launcher therefor.

Sparking toy vehicles and launchers therefor have heretofore been known in the art. In this regard, the U.S. Pat. Nos. to Kennedy No. 4,479,326 and Kakizaki No. 4,571,212 represent the closest prior art to the subject matter of the instant invention of which the applicant is aware. The patent to Kennedy discloses a toy vehicle projecting gun assembly in which the vehicle is normally latched on an inclined ramp with the rear wheels raised and free to turn. Joined to the underside of the gun is a power trigger operated by the trigger finger of the operator. On the upper side of the gun is a firing button operated by the user's thumb. Actuation of the trigger drives a gear train which in turn drives a drive gear mounted on the rear wheel axle, the drive gear being coupled to a fly-wheel. The flywheel is energized by repeated trigger actions, whereupon the player presses the firing button which unlatches the vehicle which then shoots down the ramp. The patent to Kakizaki discloses a sparking toy vehicle which is driven by a fly-wheel capable of being energized by pulling a rack gear across a pinion which is connected to the fly wheel. One of the side surfaces of the flywheel is provided with a material, which when contact by a flint, is operative for producing sparks. The flint is maintained in contact with the fly wheel surface by means of a spring-biased flint holder.

The instant invention provides a toy comprising a toy vehicle, a launching assembly, and a rotatable sparking mechanism for generating sparks before the vehicle is launched from the launching assembly. In a first embodiment, the launching assembly includes a base track having a rack gear, and a push handle including a spring biased plunger for engagement with the rear end of the vehicle. The sparking mechanism is mounted in the vehicle and a drive gear for sparking mechanism extends downwardly from the vehicle where it intermeshes with the rack gear when the vehicle is received on the base track. The push handle is slidably movable on the base track for advancing the vehicle along the base track wherein advancement of the vehicle causes rotation of the sparking mechanism thereby generating sparks, and further wherein a resistance of the sparking mechanism maintains the plunger in a depressed disposition until the drive gear disengages the rack gear. In a second embodiment, the rotatable sparking mechanism is built into the push handle wherein advancement of the push handle along the base track causes rotation of a drive gear on the push handle thereby generating sparks. The plunger is selectively maintained in a depressed position until the drive gear disengages from the rack gear. In a third embodiment, the launching assembly comprises an inclined launching surface, and a gear train including a gear extending upwardly through an aperture in the launching surface. The gear train is driven by a pivotable lever which is mounted at one end to the shaft of an actuator gear of the gear train. A cam is also mounted to the shaft of the actuator gear wherein pivoting of the lever causes the cam to engage, retract and release a spring plunger for propulsion of the car off the launcher.

Accordingly, it is an object of the instant invention to provide a sparking toy vehicle.

It is another object to provide a launcher for a toy vehicle.

It is yet another object to provide a launcher for a sparking toy vehicle which utilizes resistance between the sparking mechanism and a gear train to maintain a launching spring in a compressed position.

Other objects, features and advantages of the invention shall become apparent as the description thereof proceeds when considered in connection with the accompanying illustrative drawings.

DESCRIPTION OF THE DRAWINGS

In the drawings which illustrate the best modes presently contemplated for carrying out the present invention.

DESCRIPTION OF THE PREFERRED EMBODIMENT

Figure 1:
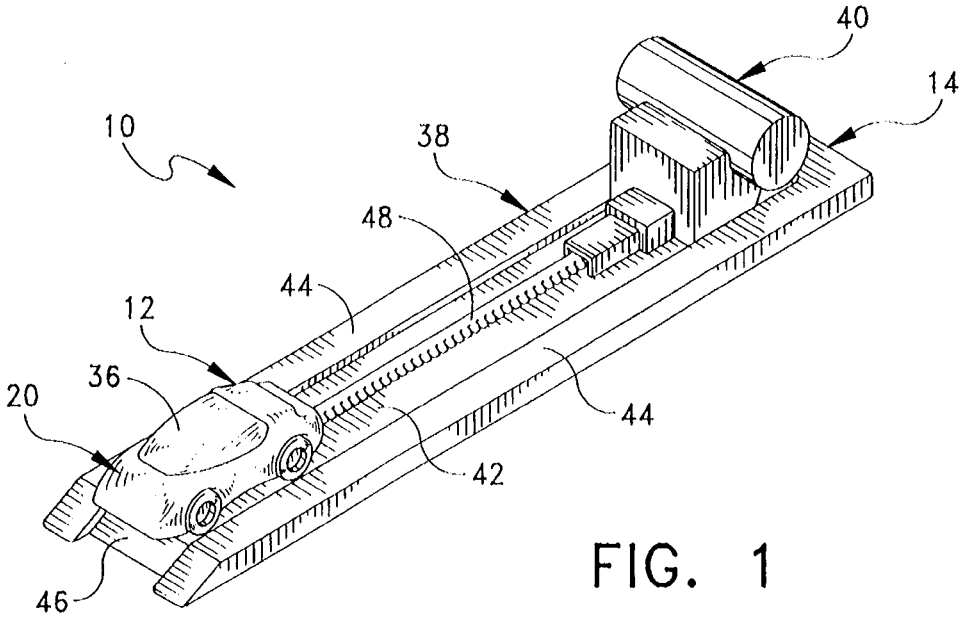
FIG. 1 is a perspective view of a first embodiment of the instant sparking toy vehicle and launcher.
Figure 2:
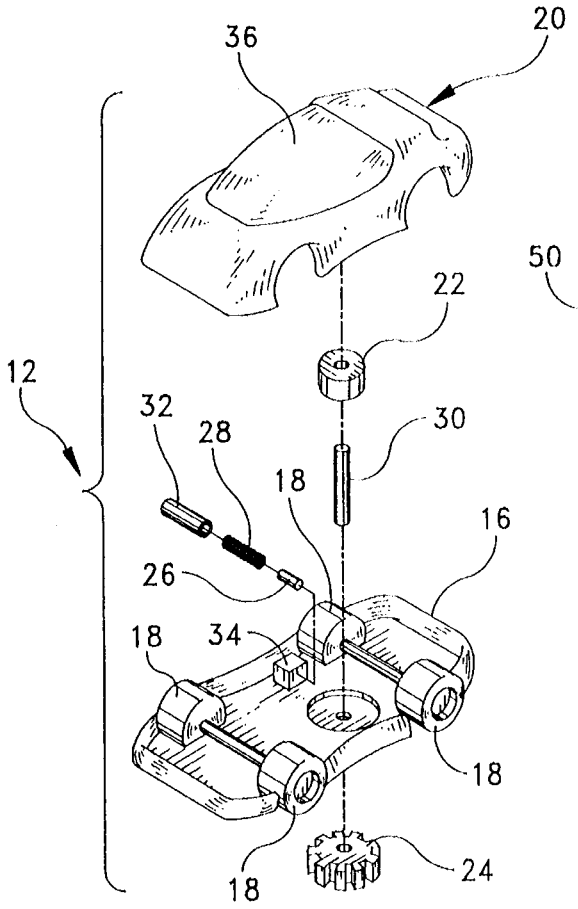
FIG. 2 is an exploded perspective view of the sparking toy vehicle thereof.
Figure 3:
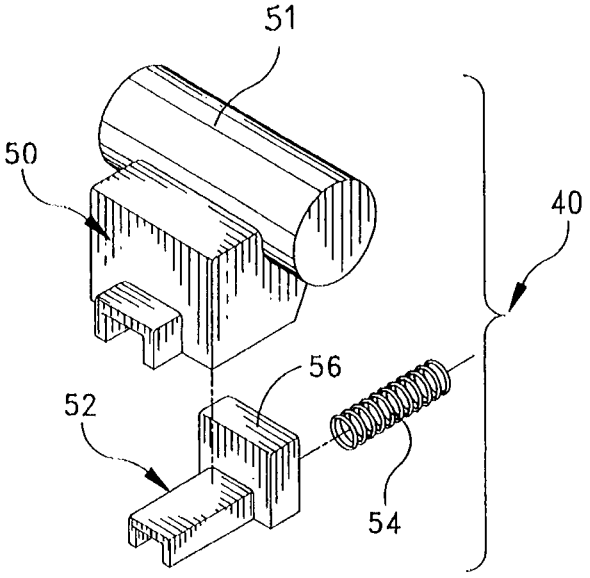
FIG. 3 is an exploded perspective view of the push handle thereof.

Referring now to the drawings, a first embodiment of the instant toy vehicle and launcher is illustrated and generally indicated at 10 in FIGS. 1–5. As will hereinafter be more fully described, each embodiment of the instant invention includes a sparking mechanism for generating sparks while the vehicle is being launched.

The first embodiment 10 comprises a toy vehicle generally indicated at 12, a launching assembly generally indicated at 14. The toy vehicle 12 is most clearly illustrated in FIG. 2 and it comprises a chassis 16, wheels 18 for rotatably supporting the chassis 16 on a supporting surface and a body generally indicated at 20. A rotatable sparking mechanism is mounted on the vehicle chassis 16 and it comprises an abrasive disc 22, a drive gear 24, a flint 26 and a spring 28 for biasing the flint 26 into engagement with the abrasive disc 22. The disc 22 and gear 24 are mounted on opposite ends of a shaft 30 which passes through the chassis 16 of the vehicle 12. The flint 26 and spring 28 are held within a flint holder 32 mounted on a block 34 on the chassis 16 adjacent the abrasive disc 22. Rotation of the drive gear 24 causes rotation of the disc 22 wherein the disc 22 and the flint 26 cooperate to generate sparks. The body 20 is preferably constructed from a translucent plastic so that the spark is visible to the user. The body 20 could alternatively comprise an opaque plastic and a colored windshield panel 36 so that the light from the sparks appears as a glow through the panel 36.

The launching assembly 14 comprises a base track generally indicated at 38 and a push handle generally indicated at 40. The base track 38 includes a supporting surface 42, bordering side walls 44 extending around three sides of the base track 38 and a inclined ramp 46 at one end thereof. The base track 38 further includes a rack gear 48 extending longitudinally along the length of the track 38. The drive gear 24 of the vehicle 12 intermeshes with the rack gear 48 when the vehicle 12 is received on the base track 38. The push handle 40 (FIG. 3) comprises a body generally indicated at 50 having a handle portion 51, and further comprises a plunger generally indicated at 52 mounted for sliding movement within the body 50. A spring 54 mounted inside the body 50 engages a flange 56 on the inner end of the plunger 52 and is operative for normally biasing the plunger 52 to an extended position (FIG. 1).

Figure 4:
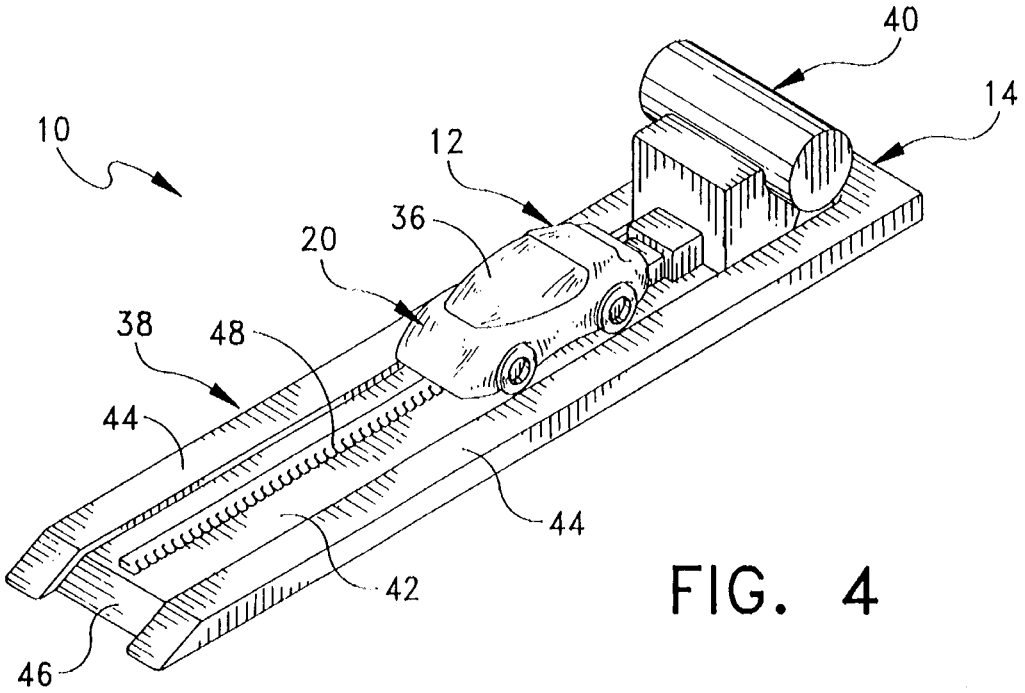
FIG. 4 is another perspective view of the toy vehicle and launcher with the vehicle loaded for launching.
Figure 5:
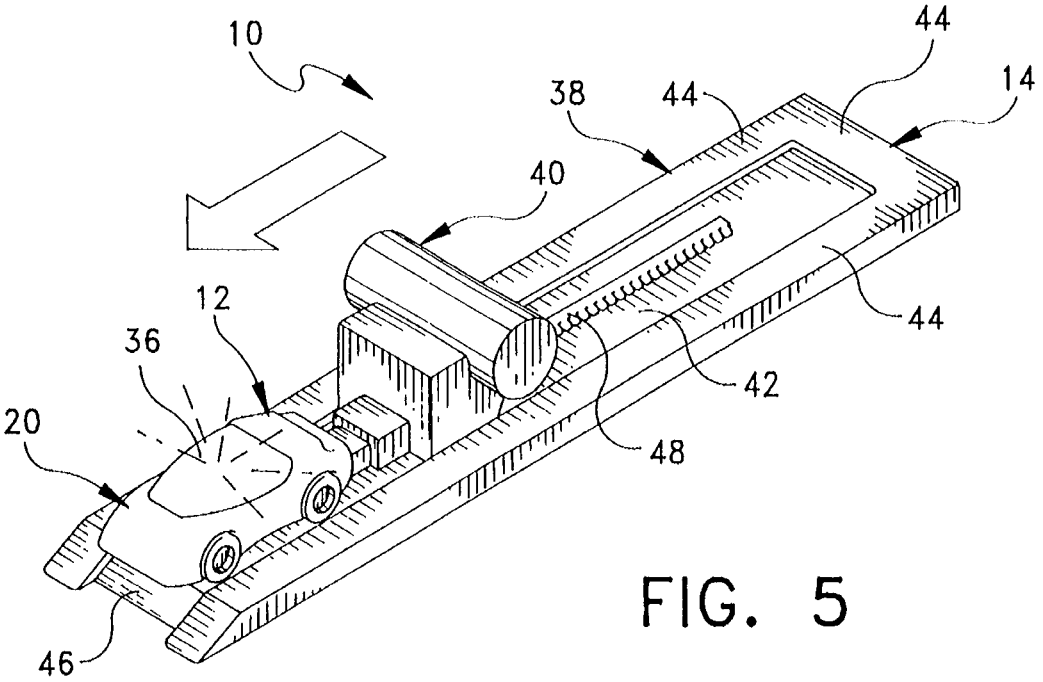
FIG. 5 is another perspective view thereof with the vehicle being advanced along the rack gear.
Figure 6:
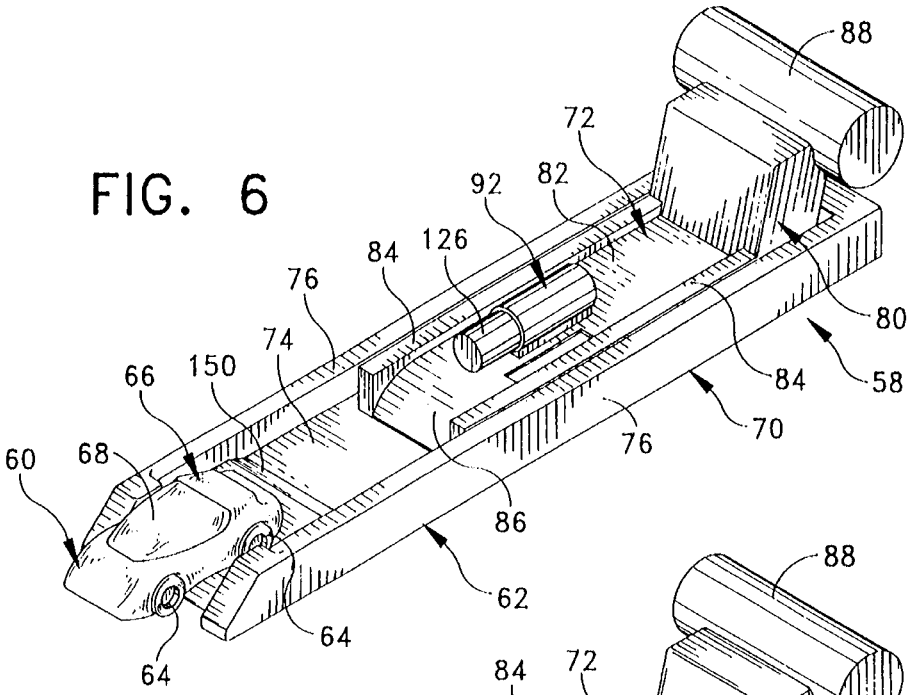
FIG. 6 is a perspective view of a second embodiment of sparking toy vehicle and launcher therefor.
Figure 8:
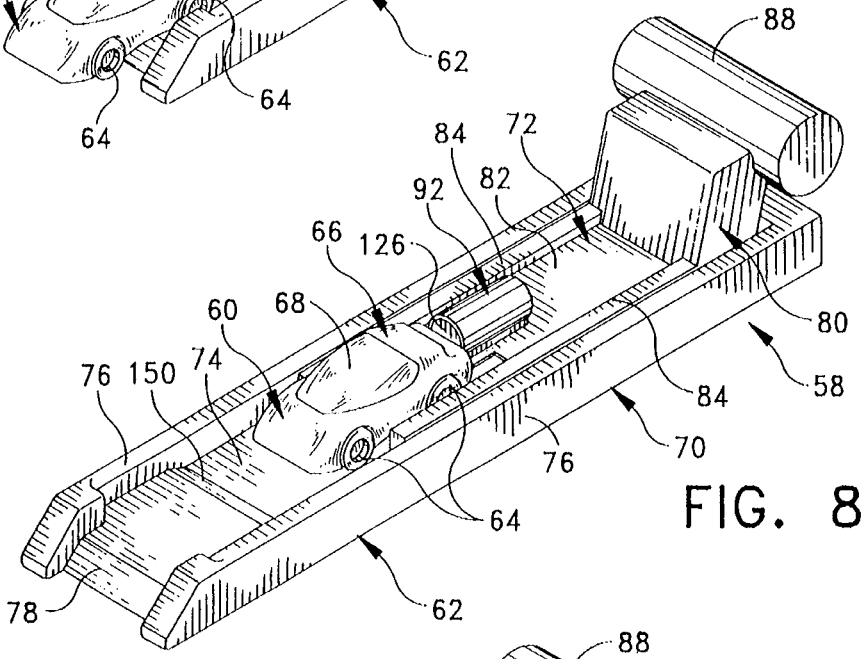
FIG. 8 is a perspective view thereof with the toy vehicle loaded thereon for launching.

In use, the vehicle 12 is mounted onto the base track 38 at the inclined surface 46 and slid rearwardly along the rack gear 48 until the rear end of the vehicle 12 engages the plunger 52 of the push handle 40 (FIG. 4). The push handle 40 is operative for advancing the vehicle 12 along the base track 38 wherein advancement of the vehicle 12 causes rotation of the drive gear 24 and corresponding rotation of the abrasive disc 22 thereby generating sparks. When the vehicle 12 is advanced along the rack gear 48, the abrasive disc 22 provides resistance to the advancement. The resistance is strong enough to depress the plunger 52 against the bias of the spring 54 and maintain the plunger 52 in a depressed disposition. When the push handle is advanced to its forwardmost position (FIG. 5) the drive gear 24 disengages from the rack gear 48 whereupon the resistance is removed and the plunger 52 quickly extends to propel the vehicle 12 from the base track 38.

A second embodiment of the instant invention is illustrated and generally indicated at 58 in FIGS. 6–9. The second embodiment 58 comprises a vehicle generally indicated at 60, and a launching assembly generally indicated at 62. The vehicle 60 comprises a chassis (not shown), wheels 64 for rotatably supporting the chassis, and body a generally indicated at 66. The body 66 is constructed from an opaque plastic and it includes a colored windshield panel 68 so that the light from the sparks generated below the vehicle 60 appears as a tinted glow through the panel 68. Alternatively, the body 66 could be constructed from a translucent plastic. The launching assembly 62 comprises a base track generally indicated at 70 and a push handle generally indicated at 72. The base track 70 includes a supporting surface 74, bordering side walls 76 extending around three sides of the base track 70 and a inclined ramp 78 at one end thereof. The base track 70 further includes a rack gear 79 (FIG. 7) extending longitudinally along the length of the track 70.

Figure 7:
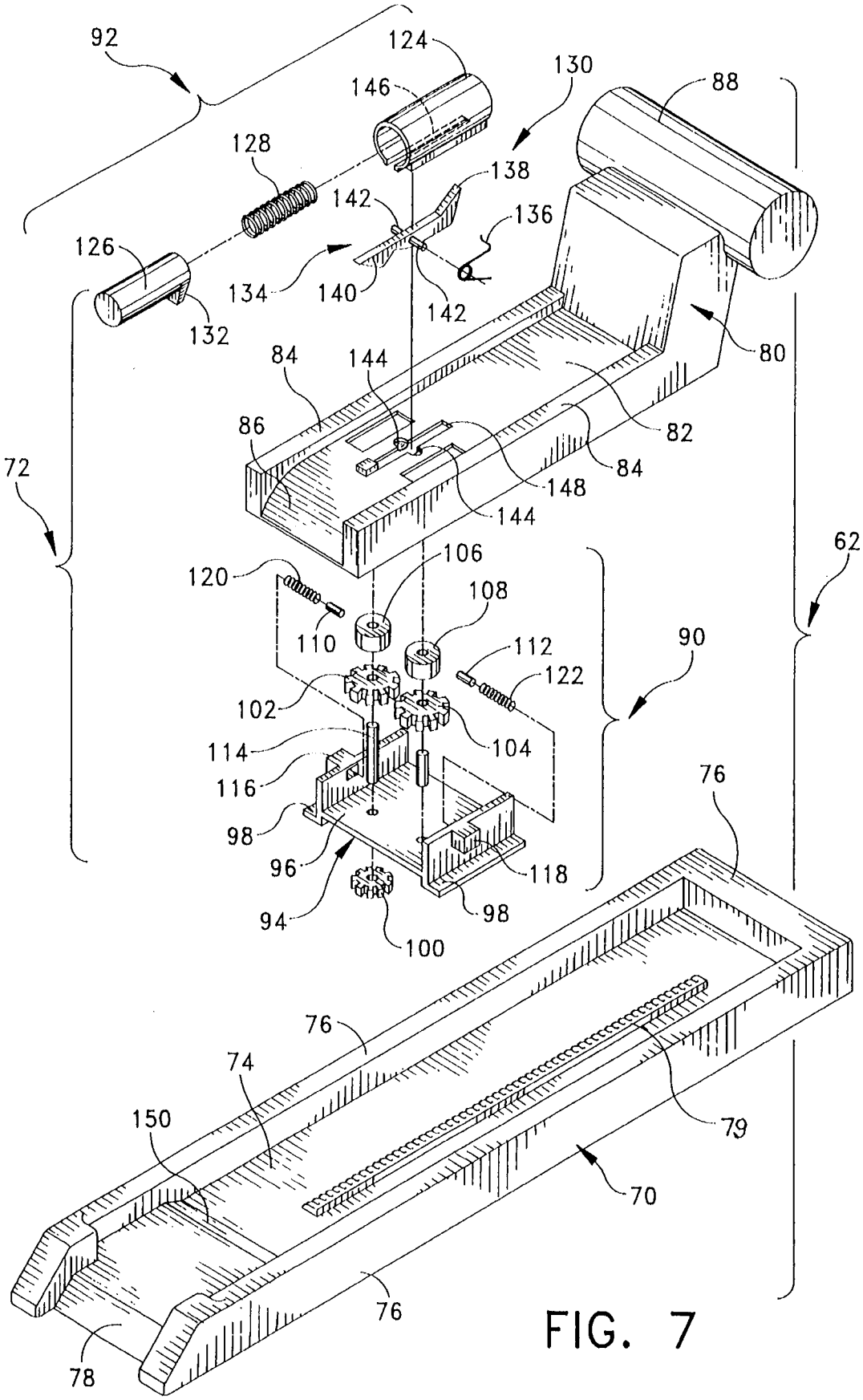
FIG. 7 is an exploded perspective view of the launcher assembly thereof.
Figure 10:
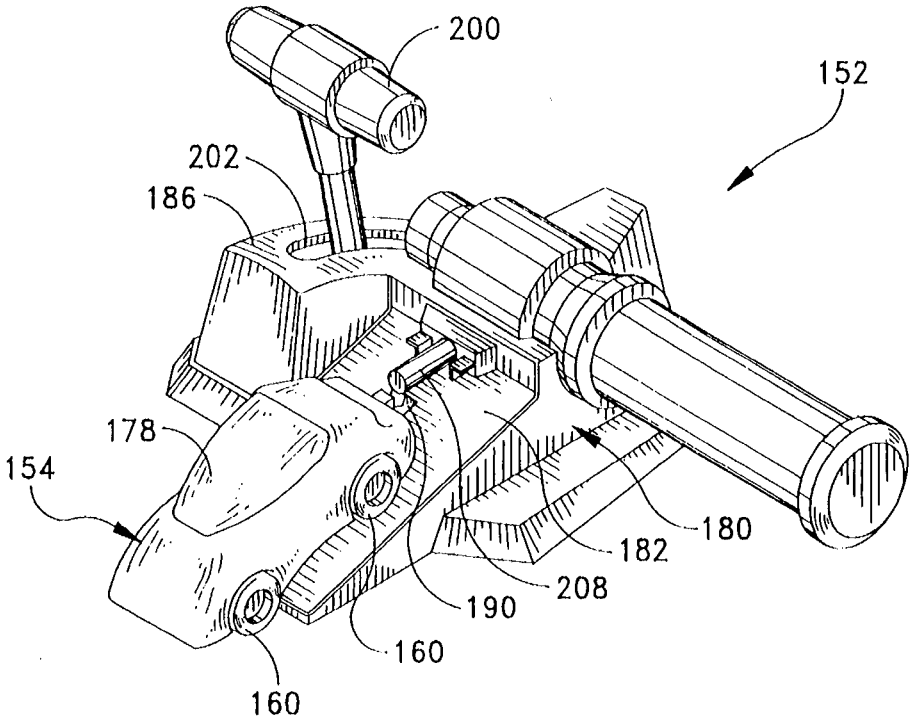
FIG. 10 is a perspective view of yet a third embodiment of the instant sparking toy vehicle and launcher therefor.
Figure 11:
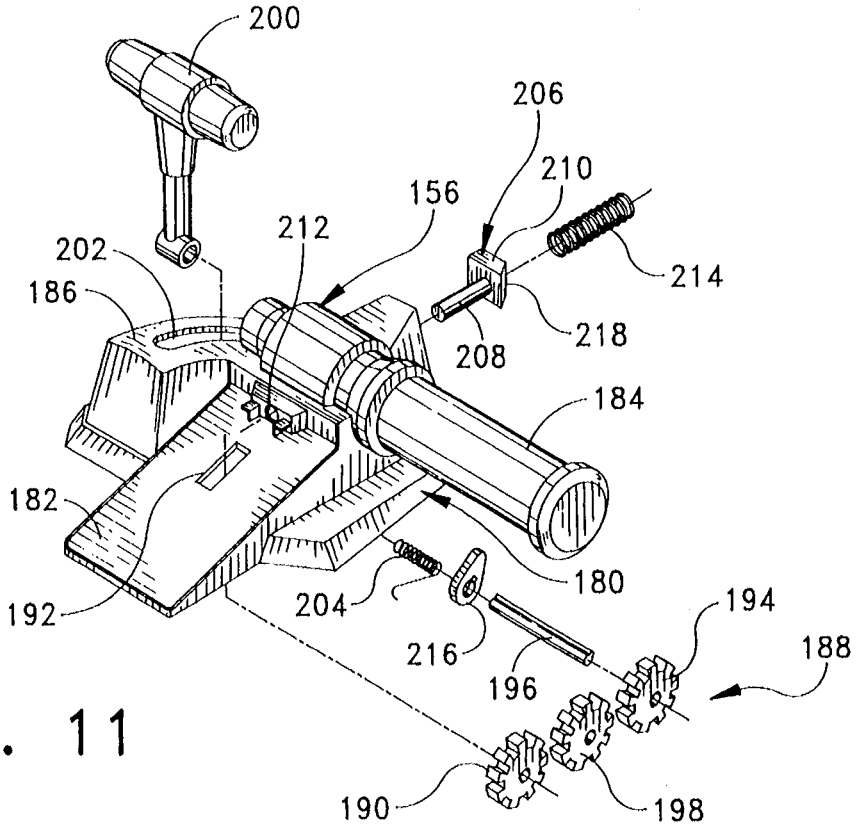
FIG. 11 is an exploded perspective view of the launcher assembly thereof.
Figure 12:
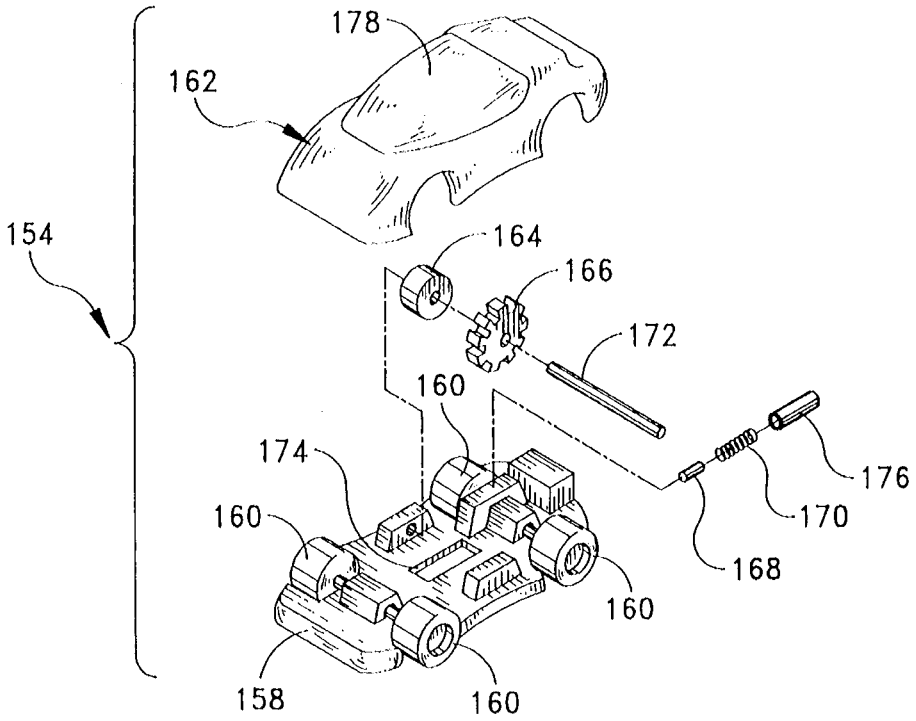
FIG. 12 is an exploded perspective view of the toy vehicle thereof.

The push handle 72 comprises a body generally indicated at 80 having supporting surface 82, opposing side walls 84, an inclined ramp 86 at one end thereof and a handle portion 88 at the opposite end. The push handle 72 further comprises an integral sparking mechanism generally indicated at 90 (FIG. 7) and a plunger assembly generally indicated at 92 (FIG. 7). The sparking mechanism 90 is mounted on a carrier generally indicated at 94 which is received beneath the supporting surface 82 of the push handle 72. The carrier 94 includes a bottom wall 96 and a pair of legs 98 for supporting the bottom wall 96 above the supporting surface 74 of the base track 70. The sparking mechanism 90 comprises a drive gear 100, first and second follower gears 102 and 104 respectively, first and second abrasive discs 106 and 108 respectively, and first and second flints 110 and 112 respectively. The drive gear 100 and first follower gear 102 are mounted on opposite ends of a shaft 114 which passes through the bottom wall 96 of the carrier 94. The second follower gear 104 is mounted on one end of a shaft 115 rotatably supported in the bottom wall 96 of the carrier 94. The first and second follower gears 102 and 104 intermesh wherein rotation of the drive gear 100 causes rotation of both of the follower gears 102 and 104. The first and second abrasive discs 106 and 108 are respectively mounted on top of the follower gears 102 and 104 for rotation thereof. The flints 110 and 112 are received in flint holders 116 and 118 formed in the legs 98 of the carrier 94. The flints 110 and 112 are biased outwardly by springs 120 and 122 for biased engagement with the abrasive discs 106 and 108. When the push handle 72 is received on the base track 70, the drive gear 100 intermeshes with the rack gear 80. Accordingly, when the push handle 72 is advanced along the base track 70, the drive gear 100 rotates thereby generating sparks.

Figure 9:
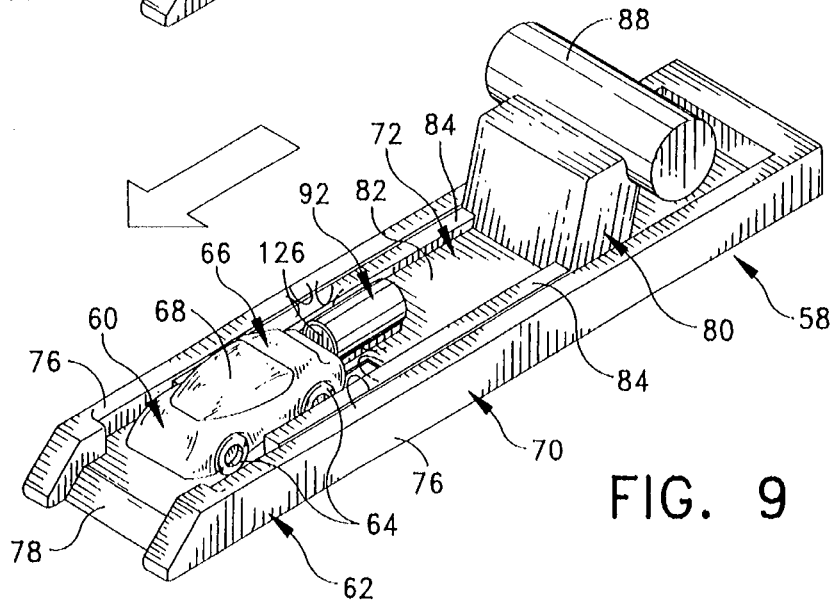
FIG. 9 is yet another perspective view with the push handle and vehicle being advanced along the rack gear.

The plunger assembly 92 is operative for propelling the vehicle 60 off the end of the push handle 72 when the push handle 72 is advanced to its forwardmost position (FIG. 9). The plunger assembly 92 comprises a tubular housing 124, a plunger 126 mounted for sliding movement inside the housing 124, a spring 128 for normally biasing the plunger 126 to an extended position, and a latching mechanism generally indicated at 130 for selectively maintaining the plunger 126 in a depressed position. The plunger 126 includes a tab 132 at the rear end thereof for engaging with the latching mechanism 130. The latching mechanism 130 comprises a latch generally indicated at 134 and a spring 136 for normally biasing the latch 134 in a counterclockwise direction. The latch 134 includes an upwardly extending tab 138 at the rear end thereof and a downwardly extending tab 140 at the front end thereof. The latch 134 is pivotably supported by two pivot pins 142 which extend outwardly from a central portion thereof. The spring 136 is received around one of the pivot pins 142 and is anchored to the inside of the housing 124 and to the latch 134. The latch 134 is pivotably mounted in a pair of depressions 144 on the supporting surface 82 of the push handle 72. The latch 134 extends upwardly into the plunger housing 124 for engagement with the tab 132 of the plunger 126 through a slot 146 formed in the bottom of the plunger housing 124 and extends downwardly through a slot 148 in the supporting surface 82 of the push handle 72 for engagement with the supporting surface 74 of the base track 70.

In use, the push handle 72 is moved rearwardly along the rack gear 80 to its rearwardmost position (FIG. 8) and the plunger 126 is depressed wherein it is maintained in the depressed position by the latching mechanism 130. In this connection, the forward tab 140 of the latch 134 rests of the supporting surface 74 of the base track 70 causing the rear tab 138 to extend upwardly into the plunger housing 124 for engagement with the plunger tab 132. The vehicle 60 is then mounted onto the push handle 72 at the inclined surface 86 so that the rear end of the vehicle 60 engages the plunger 126. The push handle 72 is thereafter operative for advancing the vehicle 60 along the base track 70 wherein advancement of the push handle 72 causes rotation of the drive gear 100 and corresponding rotation of the follower gears 102 and 104 and abrasive discs 106 and 108 thereby generating sparks. When the push handle 72 is advanced to its forwardmost position (FIG. 9), the forward tab 140 engages an inclined ramp 150 thereby pivoting the forward tab 140 upwardly and the rear tab 138 downwardly to release the plunger 126 and propel the vehicle 60 from the base track 70.

A third embodiment of the invention is illustrated and generally indicated at 152 in FIGS. 10–14. The third embodiment 152 comprises a vehicle generally indicated at 154 and a launching assembly generally indicated at 156. The toy vehicle 154 is most clearly illustrated in FIG. 12 and it comprises a chassis 158, wheels 160 for rotatably supporting the chassis 158 on a supporting surface, and a body generally indicated at 162. A rotatable sparking mechanism is mounted on the vehicle chassis 158 and it comprises an abrasive disc 164, a drive gear 166, a flint 168 and a spring 170 for biasing the flint 168 into engagement with the abrasive disc 164. The disc 164 and gear 166 are mounted on a shaft 172 which is rotatably supported on the chassis 158 of the vehicle 154. The drive gear 166 extends downwardly through an aperture 174 in the chassis 158. The flint 168 and spring 170 are held within a flint holder 176 mounted on the chassis 158 adjacent the abrasive disc 164. Rotation of the drive gear 166 causes rotation of the disc 164 wherein the disc 164 and the flint 168 cooperate to generate sparks. The body 162 includes a colored windshield panel 178 so that the light from the sparks appears as a tinted glow through the panel 178. Alternatively, the body 162 could be constructed from a translucent plastic.

Figure 13:
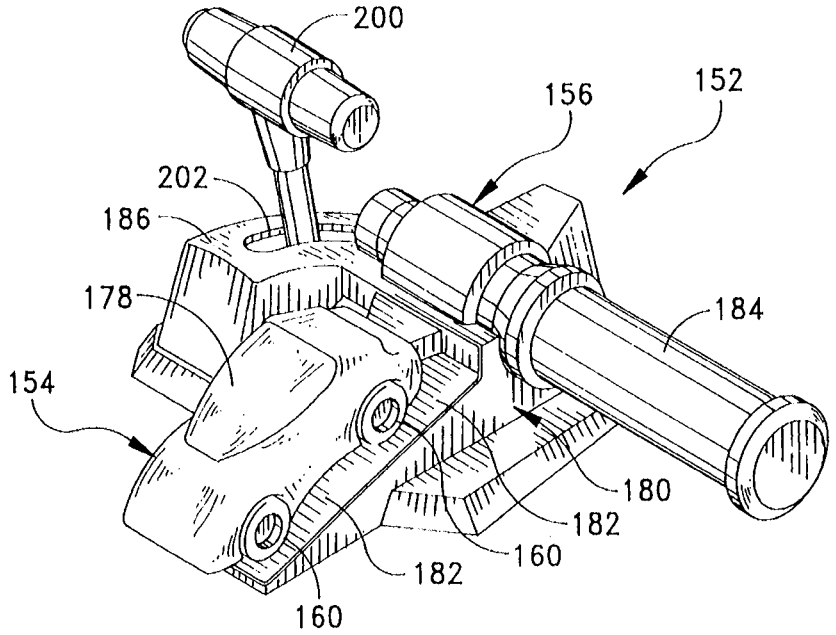
FIG. 13 is perspective view of the toy vehicle and launcher with the toy vehicle loaded in position thereon for launching.
Figure 14:
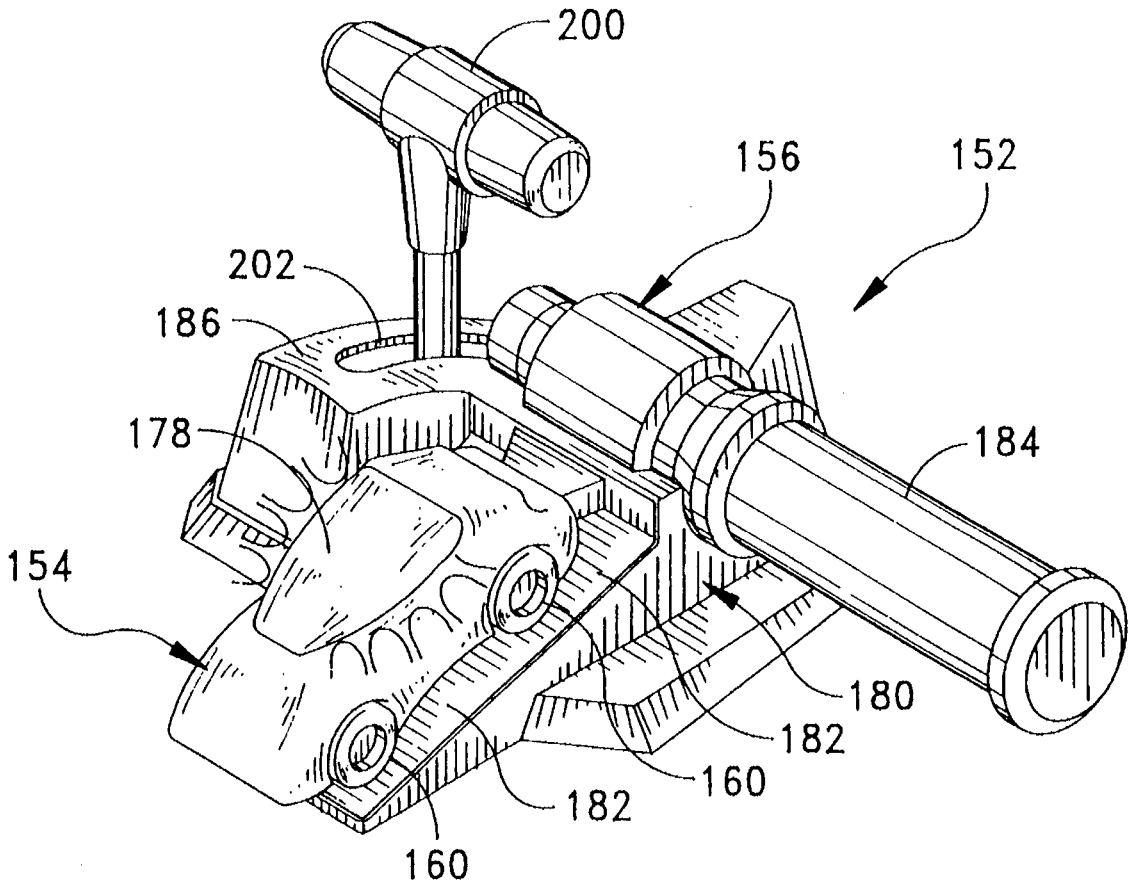
FIG. 14 is another perspective view thereof with the handle pivoted to its rearward position to rotate the parking mechanism and withdraw the plunger.

The launching assembly 156 comprises a housing generally indicated at 180 having an inclined launching surface 182 for receiving the vehicle 154 thereon, a handle portion 184, and a side portion 186. A gear train generally indicated at 188 is mounted within the housing 180. The gear train 188 includes a first gear 190 which extends upwardly through an aperture 192 in the launching surface 182. The drive gear 166 of the sparking mechanism intermeshes with the first gear 190 when the vehicle 154 is received on the launching surface 182. The drive train 188 further includes an actuator gear 194 mounted on a keyed shaft 196 and a transfer gear 198 mounted intermediate the actuator gear 194 and the first gear 190. The actuator gear 194, transfer gear 198 and first gear 190 intermesh for corresponding rotation. The actuator gear 194 is manually rotated by a lever 200 mounted on the keyed shaft 196 wherein pivoting of the lever 200 rotates the actuator gear 194. The lever 200 extends upwardly through the slot 202 in the side portion 186 and it is pivotably movable between a normal forward position (FIG. 10) and a rearward position (FIG. 13). A coil spring 204 is received around the keyed shaft 196 and is anchored to the housing 180 and the lever 200 to normally maintain the lever 200 in the forward position. The launching assembly 156 further comprises a plunger generally indicated at 206 (FIG. 11) mounted inside the housing 180 for engagement with the rear end of the vehicle 154 when the vehicle 154 is received on the launching surface 182. The plunger 206 includes a cylindrical piston 208 and a flange 210 at one end thereof. The plunger 206 is received inside the housing 180 wherein the piston 208 extends through an aperture 212 at the upper end of the launching surface 182. A spring 214 engages the flange 210 for biasing the plunger 206 to a normally extended position. The launching assembly 156 still further comprises a cam 216 (FIG. 11) for withdrawing the plunger 206 when the lever 200 is pivoted. The cam 216 is mounted on the keyed shaft 196. When the shaft 196 is rotated clockwise, i.e. the lever 200 is pulled rearwardly, the cam 216 engages the flat front surface of the flange 210 to withdraw the plunger 206 inwardly. However, when the lever 200 is fully pivoted to its rearwardmost position (FIG. 14), the cam 216 disengages the flange 210 to release the plunger 206. In order to allow the cam 216 to rotate back to its original position, the side surface 218 of the flange 210 is tapered toward the backside. Accordingly, when the lever 200 is released, the cam 216 rotates forward due to the bias of spring 204 and engages the tapered side surface 218. The tapered surface 218 causes the cam 216 to slide axially along the keyed shaft 196 and around to the front of the flange 210. When the cam 216 reaches the front surface of the flange 210, the spring 204 pulls the cam 216 back to its normal position for engagement with the front surface of the flange 210.

In use, the vehicle 154 is positioned on the inclined launching surface 182 with the drive gear 166 in intermeshing relation with the first gear 190 (FIG. 13). To launch the vehicle 154, the lever 200 is pivoted rearwardly (FIG. 14), wherein the sparking mechanism inside the vehicle 154 is rotated and the plunger 206 is withdrawn into the housing 180. When the lever 200 reaches its rearward position, the plunger 206 is released to propel the vehicle 154 off the inclined surface 182 out of engagement with the first gear 190.

It can therefore be seen that the instant invention provides three unique and entertaining toy vehicles and launchers therefor. Each embodiment of the toy includes a toy vehicle, a launching assembly and a rotatable sparking mechanism which is rotated by a gear train. Rotation of the gear train causes the sparking mechanism thereof to rotate and to thereby generate a shower of entertaining sparks. The launching assembly of each embodiment further includes a plunger for propelling the toy vehicle off the launcher while the sparks are still flying. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A toy comprising:

a vehicle;

a rotatable sparking mechanism mounted in said vehicle, said sparking mechanism including a drive gear for rotation thereof; and a launching assembly comprising a base track for receiving said vehicle thereon, and a rack gear extending along a length of said base track, said drive gear of said sparking mechanism intermeshing with said rack gear when said vehicle is received on said track base, said launching assembly further comprising a push handle mounted for sliding movement along said base track, a plunger mounted in said push handle for engagement with a rear end of said vehicle, and spring means biasing said plunger to a normally extended position, said push handle being slidably movable for advancing said vehicle along said base track wherein advancement of said vehicle causes rotation of said sparking mechanism thereby generating sparks, and further wherein a resistance of said sparking mechanism maintains said plunger in a depressed disposition until said drive gear disengages said rack gear, said plunger thereby propelling said vehicle from said base track.

2. In the toy of claim 1, said sparking mechanism comprising an abrasive disc rotatably mounted in said vehicle, said drive gear being coupled to said abrasive disc for corresponding rotation thereof, said sparking mechanism further comprising a flint mounted in said vehicle for biased engagement with said abrasive disc, said flint and said abrasive disc cooperating to generate sparks when said abrasive disc is rotated.

3. In the toy of claim 1, said vehicle including a transparent panel on an upper surface thereof.

* * * * *